US011647812B2

(12) United States Patent
Farris et al.

(10) Patent No.: US 11,647,812 B2
(45) **Date of Patent: *May 16, 2023**

(54) ARTICLE OF FOOTWEAR WITH UPPER HAVING MEMBER WITH SUPPORT ARM

(71) Applicant: NIKE, Inc., Beaverton, OR (US)

(72) Inventors: Bryan N. Farris, North Plains, OR (US); Tobie D. Hatfield, Lake Oswego, OR (US); Eric P. Avar, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/149,987

(22) Filed: Jan. 15, 2021

(65) Prior Publication Data

US 2021/0127789 A1 May 6, 2021

Related U.S. Application Data

(63) Continuation of application No. 15/624,963, filed on Jun. 16, 2017, now Pat. No. 10,932,526, which is a continuation of application No. 14/025,394, filed on Sep. 12, 2013, now Pat. No. 9,713,362.

(51) Int. Cl.
*A43B 23/02* (2006.01)
*A43B 13/14* (2006.01)
(Continued)

(52) U.S. Cl.
CPC ..... *A43B 23/0245* (2013.01); *A43B 13/14* (2013.01); *A43B 13/38* (2013.01);
(Continued)

(58) Field of Classification Search
CPC .... A43B 23/0245; A43B 23/024; A43B 13/38
See application file for complete search history.

(56) References Cited

U.S. PATENT DOCUMENTS 658,342 A 9/1900 Christensen
948,338 A 2/1910 McMaster
(Continued)

FOREIGN PATENT DOCUMENTS

CN 101562999 A 10/2009
CN 202276891 U 6/2012
(Continued)

OTHER PUBLICATIONS

International Search Report and Written Opinion for Application No. PCT/US2014/052620, dated Jan. 30, 2015.
(Continued)

*Primary Examiner* — Jillian K Pierorazio
(74) *Attorney, Agent, or Firm* — Banner & Witcoff, Ltd.

(57) ABSTRACT

An article of footwear includes a sole structure. The article of footwear further includes a first member that extends away from the sole structure. The first member at least partially defines a medial side and a lateral side of the article of footwear. Moreover, the second member has a body, a first support arm, and a second support arm. The body is attached to the first member such that the first member and the body cooperate to define a void that is configured to receive a foot. The body is also attached to the sole structure. The first support arm is attached to the first member on the medial side, and the second support arm is attached to the first member on the lateral side.

22 Claims, 9 Drawing Sheets

(51) Int. Cl.

| | |
|---|---|
| ***A43B 13/38*** | (2006.01) |
| ***A43B 13/41*** | (2006.01) |
| ***A43B 23/08*** | (2006.01) |
| ***A43B 23/26*** | (2006.01) |
| ***A43C 5/00*** | (2006.01) |

(52) U.S. Cl.

CPC ..... *A43B 13/41* (2013.01); *A43B 23/08* (2013.01); *A43B 23/26* (2013.01); *A43C 5/00* (2013.01)

(56) References Cited

U.S. PATENT DOCUMENTS 1,373,399 A 4/1921 Bean
1,599,229 A 9/1926 Given
1,809,998 A 6/1931 Wemmark
1,894,561 A 1/1933 Gaetano
2,147,197 A * 2/1939 Glidden ..... D04B 1/26 36/3 R
2,220,534 A * 11/1940 McLean ..... A43B 3/124 36/11.5
2,254,184 A 8/1941 Mayer
2,254,284 A 9/1941 Mayer
2,444,822 A 7/1948 Griffin
2,513,005 A * 6/1950 Crawford ..... A43B 3/12 D2/919
2,586,045 A 2/1952 Hoza
2,603,890 A 7/1952 Everston
2,607,131 A 8/1952 Everston
2,658,510 A 11/1953 Hilton
2,677,903 A 5/1954 Gaquin
2,748,501 A 6/1956 Martin
2,850,813 A 9/1958 Williamee
2,974,427 A 3/1961 Wolff
3,002,297 A * 10/1961 Neilson ..... A43B 3/124 D2/916
3,021,617 A 2/1962 Koch
3,335,506 A 8/1967 Saron
3,568,338 A 3/1971 Nader
3,603,006 A 9/1971 Davenport et al.
3,676,542 A 7/1972 Maltby
3,762,075 A 10/1973 Munschy
4,132,016 A 1/1979 Vaccar et al.
4,136,468 A * 1/1979 Munschy ..... A43B 3/26 36/97
4,150,498 A 4/1979 Palmer
4,279,083 A * 7/1981 Dilg ..... A43B 1/0081 36/101
4,592,152 A 6/1986 Wright et al.
4,599,811 A * 7/1986 Rousseau ..... A43B 11/00 36/97
4,706,316 A * 11/1987 Tanzi ..... A43B 9/12 12/146 D
D296,262 S 6/1988 Brown et al.
4,756,098 A 7/1988 Boggia
4,947,560 A 8/1990 Fuerst et al.
5,035,069 A 7/1991 Minden
5,317,820 A 6/1994 Bell et al.
D348,351 S 7/1994 Orzeck
5,692,319 A 12/1997 Parker et al.
5,775,006 A * 7/1998 Breuner ..... A43B 3/02 36/89
5,896,608 A * 4/1999 Whatley ..... A43B 13/28 36/12
6,000,704 A 12/1999 Balbinot et al.
6,029,376 A 2/2000 Cass
6,427,363 B1 8/2002 Hunter
6,670,029 B2 12/2003 Norton et al.
6,848,202 B2 * 2/2005 Berggren ..... A43B 3/26 36/97
D522,222 S 6/2006 Burg
7,080,466 B2 7/2006 Fischbein
7,082,703 B2 * 8/2006 Greene ..... A43B 7/26 36/94
7,168,190 B1 1/2007 Gillespie
7,204,043 B2 * 4/2007 Kilgore ..... A43B 23/042 36/105
D558,964 S 1/2008 Truelsen
7,631,440 B2 12/2009 Keen et al.
7,647,709 B2 1/2010 Reilly et al.
7,793,435 B1 9/2010 Ruth
7,845,094 B1 12/2010 Gaskins, Jr.
7,930,841 B2 * 4/2011 Luedecke ..... A43C 11/1493 D2/903
7,987,617 B2 8/2011 Kohatsu et al.
8,001,704 B2 8/2011 Baudouin
8,051,585 B2 11/2011 Hope et al.
8,127,466 B1 3/2012 Raval
8,225,530 B2 7/2012 Sokolowski et al.
8,230,618 B2 7/2012 Bruce et al.
8,286,372 B2 10/2012 Shirokikh
8,434,245 B2 * 5/2013 Bell ..... A43B 9/00 36/105
8,667,713 B2 3/2014 Baudouin
8,863,411 B2 10/2014 Berger et al.
2003/0079374 A1 * 5/2003 Belley ..... A43B 9/10 36/19 R
2004/0093761 A1 5/2004 Nye
2004/0244226 A1 12/2004 Farys et al.
2005/0060914 A1 * 3/2005 Fuerst ..... A43B 3/128 36/102
2005/0166427 A1 8/2005 Greene et al.
2005/0274042 A1 12/2005 Issler
2006/0061012 A1 3/2006 Hatfield et al.
2006/0101667 A1 5/2006 Kane
2006/0277798 A1 * 12/2006 Reilly ..... A43B 7/143 36/108
2007/0011910 A1 1/2007 Keen
2007/0199210 A1 * 8/2007 Vattes ..... A43B 7/085 36/45
2008/0047167 A1 * 2/2008 Pawlus ..... A43B 3/0047 36/15
2008/0110049 A1 5/2008 Sokolowski et al.
2008/0289222 A1 11/2008 Candrian et al.
2008/0313931 A1 * 12/2008 Adams ..... A43B 17/08 36/43
2009/0071041 A1 3/2009 Hooper
2009/0090027 A1 * 4/2009 Baudouin ..... A43B 7/1495 602/23
2010/0107442 A1 5/2010 Hope et al.
2011/0010965 A1 1/2011 Shepherd et al.
2011/0078922 A1 4/2011 Cavaliere et al.
2011/0107620 A1 5/2011 Bell et al.
2011/0113650 A1 5/2011 Hurd et al.
2011/0126428 A1 * 6/2011 Hazenberg ..... A43B 13/18 36/12
2011/0203135 A1 8/2011 DelCielo
2011/0271555 A1 11/2011 Baudouin
2012/0011744 A1 * 1/2012 Bell ..... A43B 19/00 36/91
2012/0167417 A1 * 7/2012 McDowell ..... A43B 7/085 36/107
2012/0291309 A1 * 11/2012 Ludemann ..... A43B 7/144 36/83
2013/0232818 A1 9/2013 Wiener
2013/0232824 A1 * 9/2013 Bier ..... A43B 7/088 36/25 R
2014/0237853 A1 8/2014 Fisher et al.
2014/0310987 A1 10/2014 Sokolowski et al.
2015/0143720 A1 * 5/2015 Avar ..... A43B 1/04 36/107
2017/0273404 A1 * 9/2017 Doenges ..... A43B 23/0215

FOREIGN PATENT DOCUMENTS

CN 103169196 A 6/2013
EP 1308103 A2 5/2003
EP 2277402 A2 1/2011

(56) References Cited

FOREIGN PATENT DOCUMENTS

| | | | |
|---|---|---|---|
| FR | 2565078 | A1 | 12/1985 |
| WO | 9944456 | A1 | 9/1999 |

OTHER PUBLICATIONS

Mar. 15, 2016—(WO) International Search Report on Patentability—App PCT/US2014/052620.
Oct. 9, 2019—(EP) ESR—App. No. 19177014.8.
Oasis, Footwear Terms Glossary, Sep. 11, 2013.
Mar. 6, 2023 (EP) Communication—App 19177014.8, 6 pages.

* cited by examiner

ARTICLE OF FOOTWEAR WITH UPPER HAVING MEMBER WITH SUPPORT ARM

RELATED APPLICATION DATA

This application is: (a) continuation of U.S. patent application Ser. No. 15/624,963 filed Jun. 16, 2017, which application is (b) a continuation of U.S. patent application Ser. No. 14/025,394 filed Sep. 12, 2013 (now U.S. Pat. No. 9,713,362 issued Jul. 25, 2017). Each of these is entirely incorporated herein by reference.

FIELD

The present disclosure relates to footwear and, more particularly, relates to an article of footwear with an upper having a member with a support arm.

BACKGROUND

Articles of footwear usually include an upper and a sole structure. Generally, the upper can receive the wearer's foot and secure the footwear to the foot. Also, the sole structure can provide traction for the footwear. Moreover in some embodiments, the sole structure can be resiliently compressible to provide cushioning to the wearer's foot.

More specifically, the upper can include one or more sheet-like sections of material that define a cavity for receiving the wearer's foot. The upper can also include laces, straps, buckles, buttons, and other similar components for securing the footwear to the wearer's foot.

Also, the sole structure can include a midsole. The midsole can include resiliently compressible members, such as foam, a fluid-filled bladder, or other similar members. As such, the midsole can resiliently compress under the weight of the wearer or due to impact with a ground surface. This can help distribute the resulting loads across the sole assembly and/or attenuate the loads to provide cushioning.

The sole structure can additionally include an outsole. The outsole can be made from relatively high friction material such that the outsole can readily grip the ground with firm traction. The outsole can also include grooves, sipes, recesses, or other features that increase surface area of the ground engaging surface, that can channel water away from the ground engaging surface, or otherwise increase such traction for the article of footwear.

SUMMARY

An article of footwear having a medial side and a lateral side is disclosed. The article of footwear can include a sole structure. The article of footwear can further include a first member that extends away from the sole structure. The first member can at least partially define the medial side and the lateral side. Moreover, the second member can have a body, a first support arm, and a second support arm. The body can be attached to the first member such that the first member and the body cooperate to define a void that is configured to receive a foot. The body can also be attached to the sole structure. The first support arm can be attached to the first member on the medial side, and the second support arm can be attached to the first member on the lateral side.

Moreover, an article of footwear is disclosed that can include a sole structure and a first member that extends away from the sole structure. The first member can have a lower peripheral edge that is adjacent the sole structure. Additionally, the article of footwear can include a second member with a body and at least one support arm that extends away from the body. The body can be attached to the lower peripheral edge such that the body and the first member cooperate to define a void that is configured to receive a foot. The body can also attach to the sole structure. The at least one support arm can extend away from the sole structure, and the at least one support arm can be layered on and attached to the first member.

Still further, a method of manufacturing an article of footwear is disclosed. The method can include providing a first member having a lower peripheral edge. The method can also include providing a second member having a body and at least one support arm that extends away from the body. The body can define a sole engaging surface. The method can additionally include attaching the body of the second member to the lower peripheral edge such that the body and the first member cooperate to define a void that is configured to receive a foot. Additionally, the method can include layering and attaching the at least one support arm on the first member. Still further, the method can include attaching the sole structure to the sole engaging surface of the body of the second member.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

Figure 1:
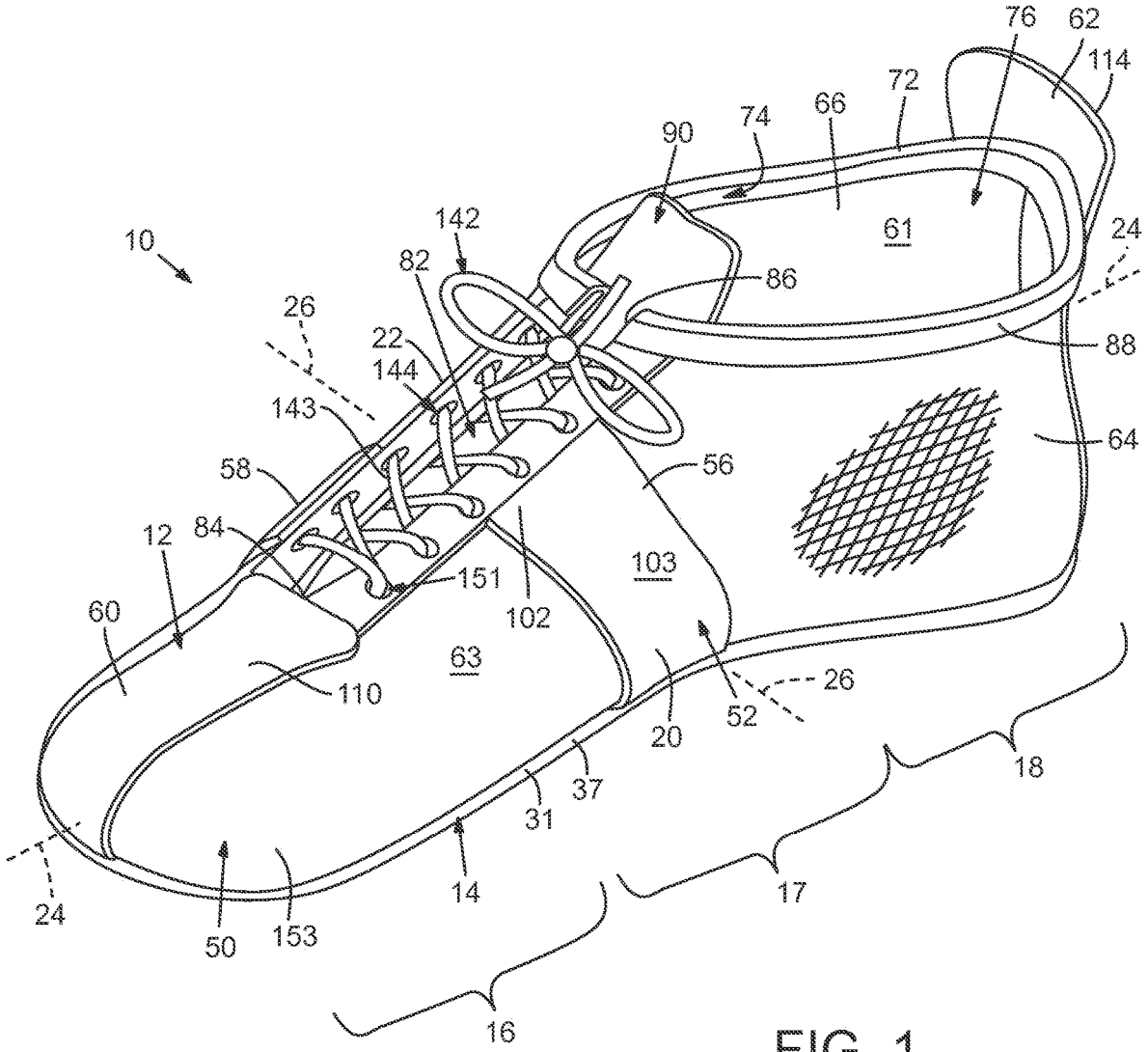
FIG. 1 is a perspective view of an article of footwear according to exemplary embodiments of the present disclosure.
Figure 2:
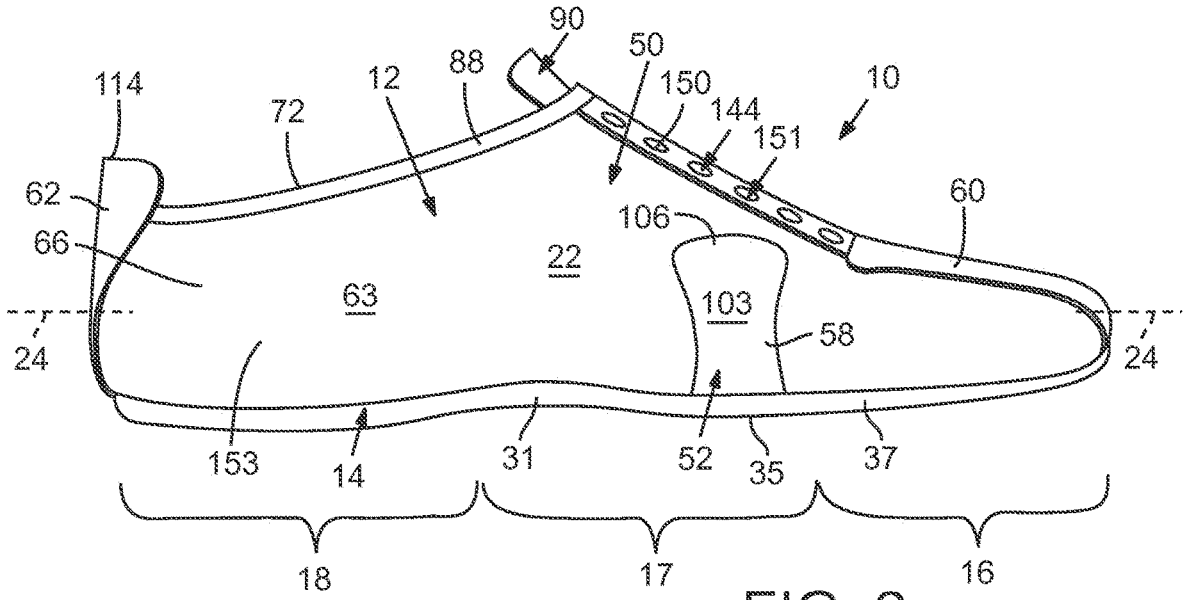
FIG. 2 is a lateral side view of the article of footwear of FIG. 1.
Figure 3:
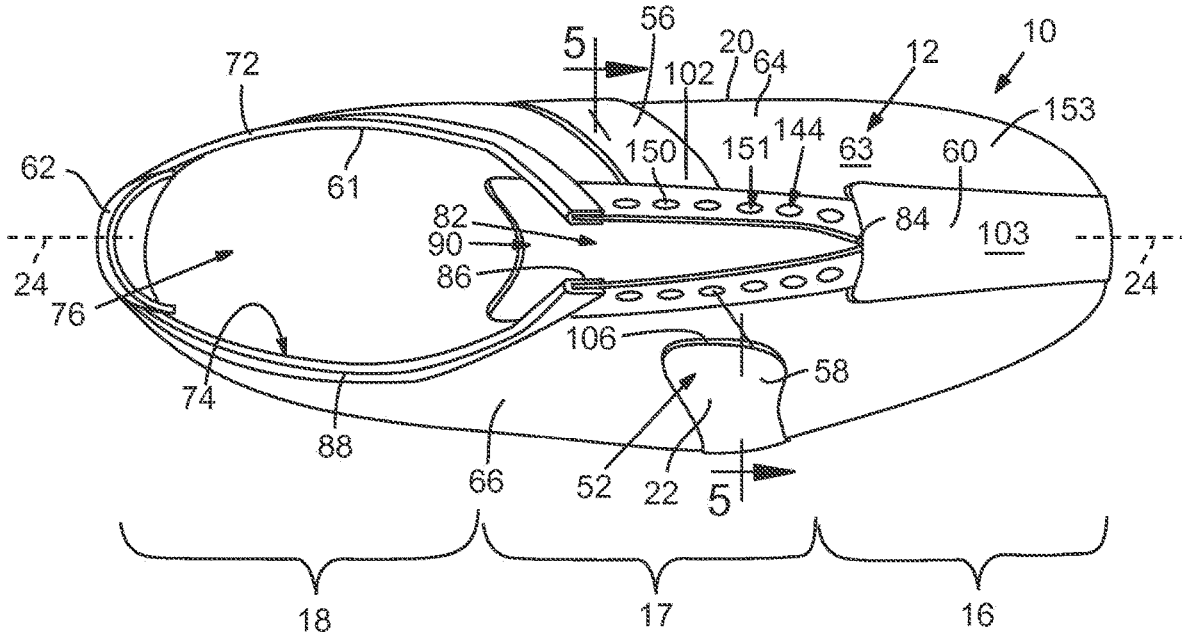
FIG. 3 is a top view of the article of footwear of FIG. 1.
Figure 4:
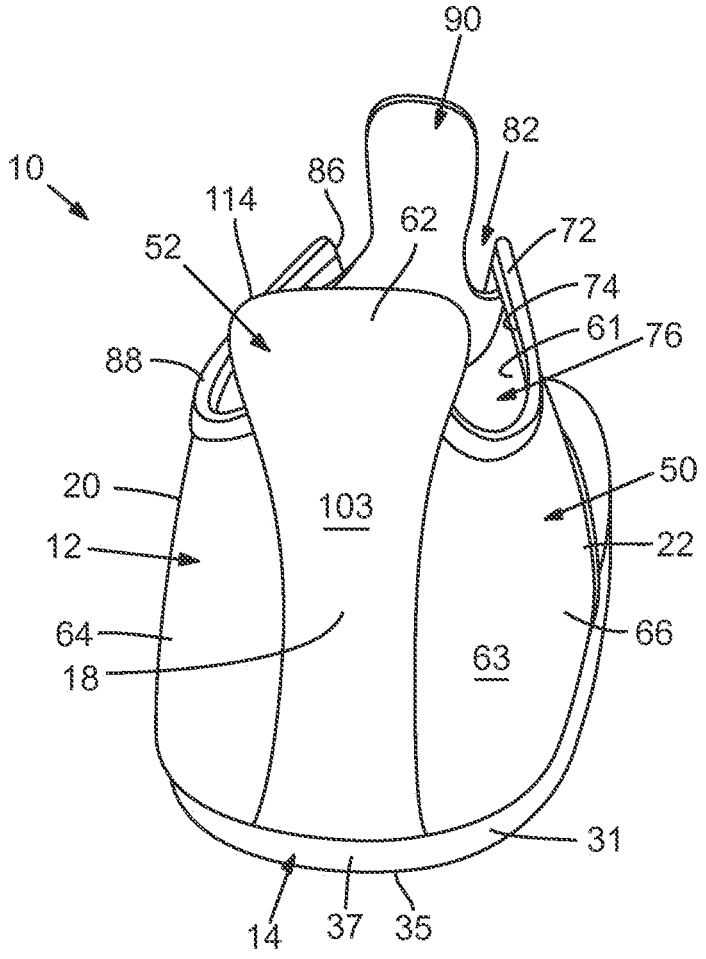
FIG. 4 is a rear view of the article of footwear of FIG. 1.

Example embodiments will now be described more fully with reference to the accompanying drawings. As will be discussed, an article of footwear is disclosed below according to exemplary embodiments of the present disclosure. The article of footwear can be relatively lightweight. Also, the article of footwear can include a relatively small number of parts. Moreover, multiple features of the footwear can be combined into a single part. Accordingly, the footwear can be comfortable to wear. Also, the wearer is less likely to be weighed down by the footwear during running, jumping, or other ambulatory activities. Moreover, manufacturing efficiency can be increased due to the features discussed below.

Referring initially to FIGS. 1-4, exemplary embodiments of an article of footwear 10 are illustrated according to various teachings of the present disclosure. Although the article of footwear 10 is illustrated as an athletic shoe, it will be appreciated that the footwear 10 could be a boot, a sandal, or any other type without departing from the scope of the present disclosure.

For reference purposes, the article of footwear 10 may be divided into three general regions: a forefoot region 16, a midfoot region 17, and a heel region 18. Forefoot region 16 can generally support forward portions of the wearer's foot, including the toes and joints connecting the metatarsals with the phalanges. Midfoot region 17 can generally support middle portions of the wearer's foot, including an arch area. Heel region 18 can generally support rear portions of the wearer's foot, including the heel and calcaneus bone. Footwear 10 can also include a lateral side 22 and a medial side 20. The lateral side 22 and medial side 20 can be disposed on opposite sides of a longitudinal axis 24 of footwear 10. The forefoot region 16 and the heel region 18 can be disposed on opposite sides of a transverse axis 26 of the footwear 10. Also, lateral side 22 can correspond with an outside area of the wearer's foot, and medial side 20 can correspond with an inside area of the wearer's foot. Forefoot region 16, midfoot region 17, heel region 18, lateral side 22, and medial side 20 are not intended to demarcate precise areas of upper 10. Rather, forefoot region 16, midfoot region 17, heel region 18, lateral side 22, and medial side 20 are intended to represent general areas of upper 10 to aid in the following discussion.

In some embodiments, the footwear 10 can have a very low total weight. As such, the footwear 10 can allow the wearer to run faster, to run longer distances with less fatigue, to jump higher, or to otherwise enhance the wearer's performance. Moreover, the footwear 10 can be sleek and can conform closely to the wearer's foot for added comfort and for aesthetic appeal. Also, the footwear 10 can include several features that provide reinforcement, robustness, and strength to the footwear 10. Accordingly, the footwear 10 can withstand high stress and can be used over a long period of time without tearing or otherwise failing.

Moreover, some embodiments of the article of footwear 10 can include a part that extends continuously from one area of the footwear 10 to a different area. For example, a part can be included that extends continuously between the medial side 20 and the lateral side 22. In additional embodiments, a part can be included that extends continuously between the forefoot region 16 and the heel region 18. Thus, this part can interconnect two opposite areas of the article of footwear 10. This configuration can help to reinforce the article of footwear 10 and also provide additional structure to the article of footwear 10. This configuration can also help to provide additional support to the wearer's foot.

In some embodiments, the part can, in essence serve two functions: helping to join an upper with a sole structure, while at the same time, providing additional structural support to the upper 12. Because this part can serve multiple functions, redundant components can be eliminated. Also, components that would otherwise be used to reinforce the footwear 10 or support the wearer's foot can be eliminated. Accordingly, the footwear 10 can be made lightweight, and yet, the footwear 10 can provide sufficient support to the wearer's foot and can be sufficiently robust.

Generally, the article of footwear 10 can include an upper 12 and a sole structure 14 that are attached together. The upper 12 can define a void 76 that can receive the wearer's foot, and the sole structure 14 can be disposed underneath the upper 12 and, thus, underneath the sole of the wearer's foot. As such, the sole structure 14 can provide traction, protect the sole of the wearer's foot, provide cushioning, attenuate impact forces, or provide other benefits.

Referring now to FIGS. 1, 2, and 4-7, the sole structure 14 will be discussed in greater detail according to embodiments of the present disclosure. As shown in the illustrated embodiments, the sole structure 14 can include an outsole 31. The outsole 31 can be attached directly to the upper 12. In other embodiments, the sole structure 14 can include a midsole between the upper 12 and the outsole 31, and the midsole can be made from resilient materials, bladders, or other items that resiliently deform and compress to attenuate impact forces. However, those having ordinary skill in the art will recognize that the article of footwear 10 shown in the illustrated embodiments does not include a midsole. Stated differently, the sole structure 14 of the footwear 10 can be "midsole-less".

The outsole 31 can include one or more pads of high friction, resiliently elastic material. Also, the outsole 31 can define a ground engaging surface 35 that engages the ground, floor, running track, or other supporting surface. The ground engaging surface 35 can include grooves, ridges, sipes, projections, cleats, or other features that increase traction, that increase flexibility of the outsole 31, or that channel water away from the outsole 31. Moreover, the outsole 31 can define an upper engaging surface 40 that faces in an opposite direction from the ground engaging surface 35. The upper engaging surface 40 can attach to the upper 12 as will be discussed. Still further, the outsole 31 can define a peripheral side surface 37 that extends between the upper engaging surface 40 and the ground engaging surface 35. In some embodiments, the outsole 31 and the sole structure 14 can incorporate one or more of the features disclosed in U.S. Patent Publication No. 2015/0068063 A1, entitled "Outsole With Stepped Projections For Article of Footwear" (U.S. patent application Ser. No. 14/025,351, which was filed on Sep. 12, 2013 and lists Bryan N. Farris as the inventor), and which is incorporated by reference in its entirety.

Referring now to FIGS. 1-7, footwear 10 may include an upper 12. Generally, the upper 12 can include a first member 50 and a second member 52 in some embodiments. The first member 50 and the second member 52 can be attached together and can cooperate to define a void 76 that receives the wearer's foot. When the footwear 10 is worn on a foot, the first member 50 can generally extend from the sole structure 14 and over and around the wearer's foot. In some embodiments, the first member 50 can substantially define the forefoot region 16, the heel region 18, the medial side 20, and/or the lateral side 22 of the upper 12. Also, in some embodiments, the second member 52 can extend underneath the wearer's foot. The second member 52 can function in a manner similar to a "strobel," "strobel sock," or "strobel member." The second member 52 can also be attached to the sole structure 14. More specifically, the sole structure 14 can be layered over and attached to the outsole 31 as shown in FIGS. 1-7. In other embodiments, the sole structure 14 can include a midsole; therefore, the second member 52 can be layered over and attached to the midsole in some embodiments.

Some embodiments can include provisions for reinforcing the upper 12. In some cases, these reinforcing features may be integrated with other components. In some embodiments, a reinforcing feature may be associated with second member 52. In some cases, this reinforcing feature may be a device or component attached to second member 52.

As shown in the embodiments shown in FIGS. 1-7, the second member 52 can include one or more portions that extend away from the sole structure 14 and that attach to the first member 50. These portions can reinforce the first member 50 in some embodiments such that the footwear 10 is more robust. These portions can also cover certain areas of the first member 50 to provide greater comfort to the wearer's foot and/or to improve the aesthetics of the footwear 10. The second member 52 can include portions that extend continuously between opposing areas of the first member 50 in some embodiments. As such, the second member 52 can interconnect those opposing areas of first member 50. The second member 52 can also extend underneath the wearer's foot and can curve upward to opposing areas over the wearer's foot. As such, the second member 52 can somewhat "cradle" the wearer's foot in some embodiments. Accordingly, the second member 52 can support the wearer's foot, distribute loads across the first member 50, and provide added comfort.

The first member 50 of the upper 12 will now be discussed in detail according to exemplary embodiments. As shown in FIG. 1, for example, the first member 50 can extend between the forefoot region 16, the heel region 18, the medial side 20, and the lateral side 22 of the article of footwear 10. The first member 50 can include an interior surface 61 that at least partially defines the void 76 within the upper 12. The first member 50 can also include an exterior surface 63 that faces outward in an opposite direction from the interior surface 61.

Figure 5:
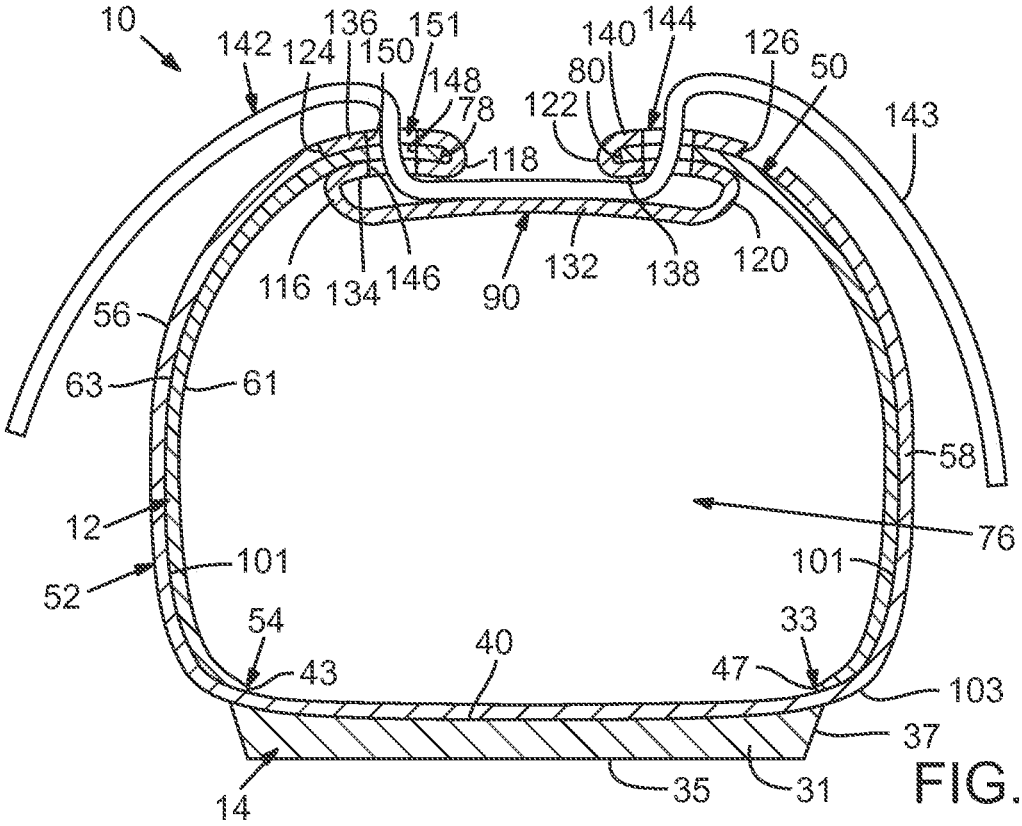
FIG. 5 is a section view of the article of footwear taken along the line 5-5 of FIG. 3, wherein a shoelace of the footwear is shown untied.
Figure 6:
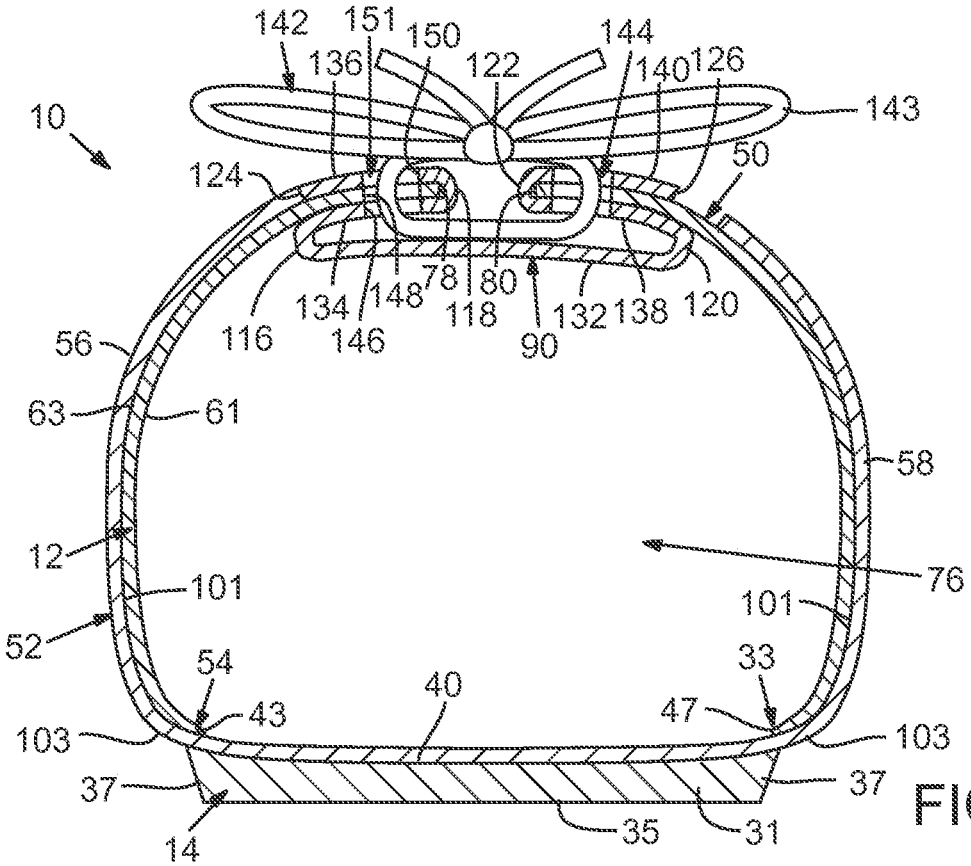
FIG. 6 is a section view of the article of footwear of FIG. 1 shown with the shoelace tied.
Figure 9:
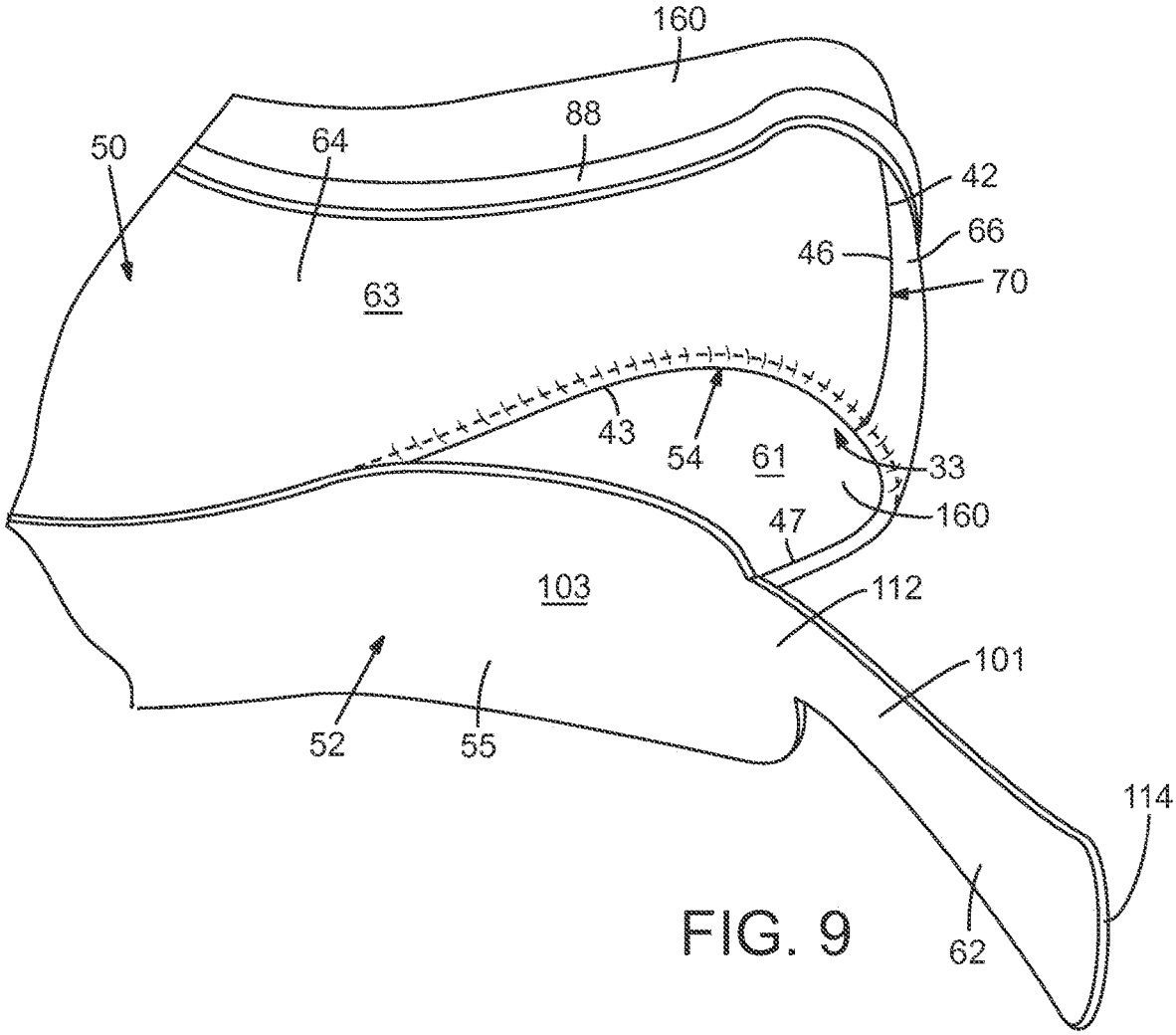
FIG. 9 is a bottom perspective view schematically illustrating further manufacture of the article of footwear of FIG. 1.

Also, the first member 50 can include an ankle opening 74 that is defined by a rim 72 and that provides access into and out of the internal void 76 within the upper 12. Additionally, the first member 50 can include a throat opening 82 that extends along the longitudinal axis 24 between the medial side 20 and the lateral side 22. The throat opening 82 can be elongate and can include a forward end 84 and a rear end 86. The forward end 84 can be disposed in the forefoot region 16, and the rear end 86 can be disposed adjacent the ankle opening 74. As will be discussed, the size of the throat opening 82 can be selectively varied. For example, the width or girth of the throat opening 82 along the transverse axis 26 can be selectively changed. As such, the footwear 10 can be widened for inserting and removing the wearer's foot from the footwear 10, and the footwear 10 can also be tightened around the wearer's foot for securing the foot within the footwear 10. Moreover, the first member 50 can include a lower peripheral edge 54, which is shown in FIGS. 5, 6, and 9. As shown, the lower peripheral edge 54 can define an underfoot opening 33. The lower peripheral edge 54 can extend continuously about the footwear 10 and can be disposed adjacent the sole structure 14. As will be discussed, the second member 52 can be attached to the first member 50 along the lower peripheral edge 54.

Figure 7:
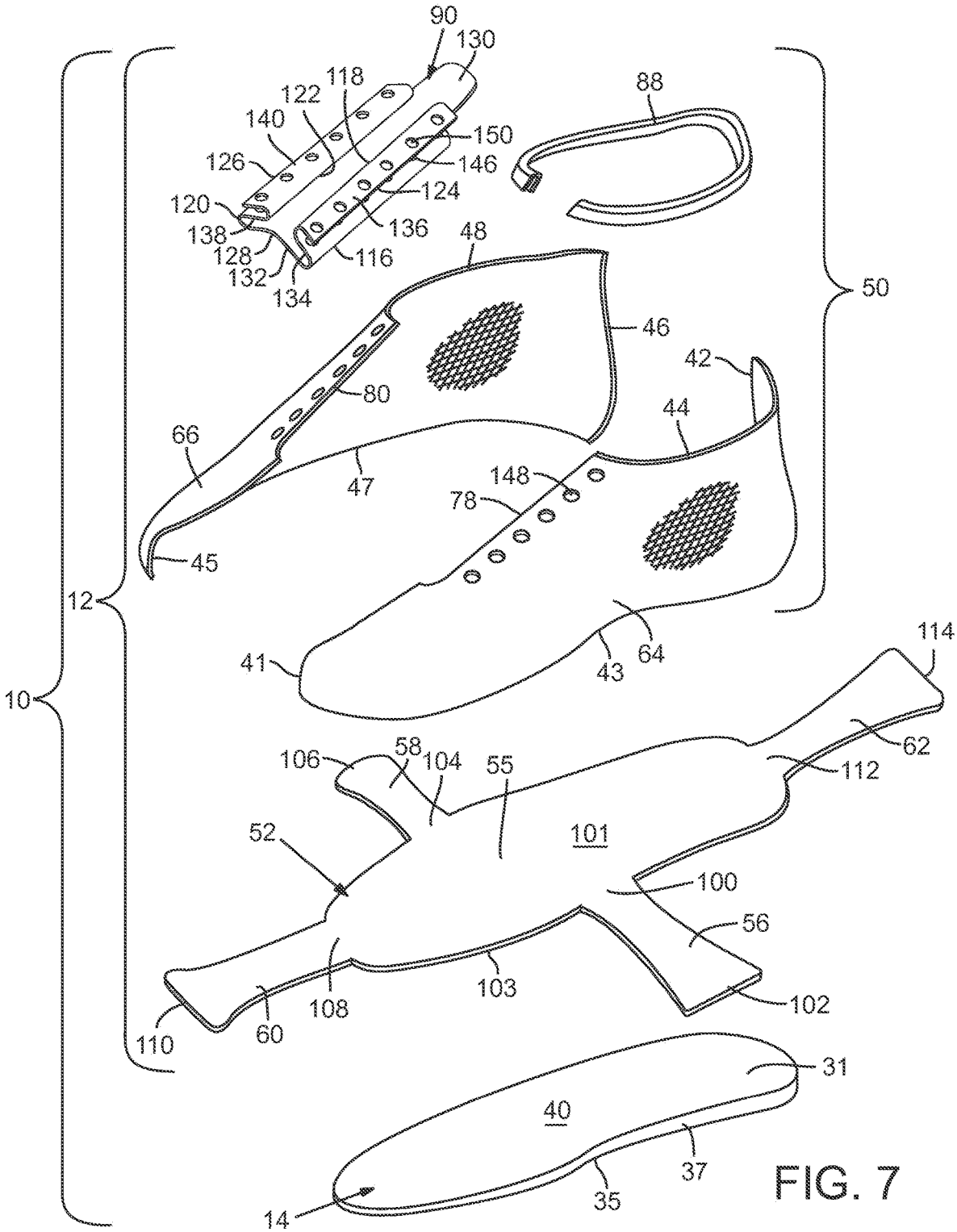
FIG. 7 is an exploded view of the article of footwear of FIG. 1.

As shown in FIG. 7, the first member 50 can include and can be substantially assembled from a plurality of parts, pieces, panels, or other components that cooperate to define the first member 50. It will be appreciated that the first member 50 can include any suitable number of parts. For example, the first member 50 can include a first panel 64 and a second panel 66. The first panel 64 and the second panel 66 can be made out of a sheet of material and can have one or more three dimensionally curved surfaces. The first panel 64 can include a forward edge 41, a rear edge 42, and a lower edge 43 that extends between the forward edge 41 and the rear edge 42 in some embodiments. Also, the second panel 66 can include a forward edge 45, a rear edge 46, and a lower edge 47 that extends between the forward edge 45 and the rear edge 46 in some embodiments. The forward edge 41 of the first panel 64 can be attached to the forward edge 45 of the second panel 66 at a first seam 68 as will be discussed. Also, the rear edge 42 of the first panel 64 can be attached to the rear edge 46 of the second panel 66 at a second seam 70 as will be discussed. Thus, as shown in the illustrated embodiments, the first panel 64 can substantially define the medial side 20 of the upper 12, and the second panel 66 can substantially define the lateral side 22 of the upper 12. Moreover, when the first panel 64 and the second panel 66 are attached, the lower edge 43 of the first panel 64 and the lower edge 47 of the second panel 66 can cooperate to define the lower peripheral edge 54 of the upper 12 as shown in FIG. 9.

The first panel 64 can also include a throat edge 78 and an upper edge 44, and the second panel 66 can include a throat edge 80 and an upper edge 48 in some embodiments as shown in FIG. 7. When the first panel 64 and the second panel 66 are attached, the throat edge 78 of the first panel 64 and the throat edge 80 can cooperate to define the throat opening 82 of the upper 12. Also, the upper edge 44 of the first panel 64 and the upper edge 48 of the second panel 66 can cooperate to define the ankle opening 74 of the upper 12. Still further, the first panel 64 and the second panel 66 can cooperate to substantially define the interior surface 61 and the exterior surface 63 of the first member 50.

In some embodiments, the first panel 64 and/or the second panel 66 can be made from lightweight material. For example, the first panel 64 and the second panel 66 can be made from mesh-type material as represented in FIGS. 1 and 7. As such, the weight of the footwear 10 can be relatively low, and air can readily flow in and out of the upper 12 for added comfort. Also, in some embodiments, the first panel 64 can be made from two or more overlapping layers of material. Likewise, the second panel 66 can be made from two or more overlapping layers of material.

In some embodiments, first member 50 can also include a collar 88. The collar 88 can be a strip of material that is attached to the first panel 64 and/or the second panel 66, adjacent the ankle opening 74. For example, the collar 88 can be folded over and attached to the upper edge 44 of the first panel 64 and the upper edge 48 of the second panel 66. In some embodiments, the collar 88 can extend continuously from the first throat edge 78 to the second throat edge 80 so as to substantially encircle the ankle opening 74 and to define the rim 72 of the opening. The collar 88 can be attached to the first panel 64 and the second panel 66 using adhesives, stitching, fasteners, or any other suitable fixation device.

Moreover, the first member 50 of the upper 12 can include a tongue 90. The tongue 90 can be disposed within throat opening 82 and can extend between the first throat edge 78 and the second throat edge 80.

For example, as shown in FIG. 7, the tongue 90 can be a sheet of material with a medial edge 124, a lateral edge 126, a forward edge 128, and a rear edge 130. The tongue 90 can also be a single panel of material that defines the medial edge 124, the lateral edge 126, the forward edge 128, and the rear edge 130. In other words, the tongue 90 can be a unitary piece of material. In other embodiments, the tongue 90 can include two or more attached pieces of material that cooperate to define the tongue 90.

Also, as shown in FIG. 7, the tongue 90 can extend across the throat opening 82 and can be attached to the first throat edge 78 and the second throat edge 80. Additionally, in some embodiments, the tongue 90 can include one or more folds such that the tongue 90 can receive the first throat edge 78 and/or the second throat edge 80. For example, the tongue 90 can be folded along the medial edge 124 and/or the lateral edge 126. More specifically, as shown in FIG. 7, the tongue 90 can be folded twice along the medial edge 124 to include a first fold 116 and a second fold 118, and the tongue 90 can also be folded twice along the lateral edge 126 to include a third fold 120 and a fourth fold 122. Thus, as shown in the cross-section of FIG. 5, the tongue 90 can include a first layer 132 that extends laterally between the first throat edge 78 and the second throat edge 80. Moreover, the tongue 90 can include a second layer 134 and a third layer 136 that overlap the first layer 132 of the tongue 90. As shown, the first throat edge 78 can be received between the second layer 134 and the third layer 136 of the tongue 90. Also, the tongue 90 can include a fourth layer 138 and a fifth layer 140 that overlap the first layer 132 of the tongue 90. As shown, the second throat edge 80 can be received between the fourth layer 138 and the fifth layer 140 of the tongue 90. In some embodiments, the first throat edge 78 can be fixed to the second layer 134 and/or the third layer 136 of the tongue 90. Also, the second throat edge 80 can be fixed to the fourth layer 138 and the fifth layer 140. For example, in some embodiments, the first throat edge 78 can be attached to both the second layer 134 and the third layer 136 via adhesives, via stitching, via fasteners, or using other attachment devices. Similarly, the second throat edge 80 can be attached to both the fourth layer 138 and the fifth layer 140 via adhesives, via stitching, via fasteners, or using other attachment devices.

Additionally, the article of footwear 10 can include a closure member 142 or securing device that can be used to selectively secure the footwear 10 to the wearer's foot. The closure member 142 can be of any suitable type, such as shoelaces, a strap, hook-and-loop tape such as VELCRO™, buttons, snaps, buckles, hooks, or any other type of closure member 142.

For example, the footwear 10 can include a shoelace 143. The shoelace 143 can alternate between the first throat edge 78 and the second throat edge 80 as the shoelace 143 extends between the rear end 86 and the forward end 84 of the throat opening 82. Also, the shoelace 143 can be secured to the first throat edge 78 and the second throat edge 80 in any suitable fashion. For example, the shoelace 143 can be received in eyelets, grommets, or loops, the shoelace 143 can be fastened around hooks, or the shoelace 143 can be attached to the first throat edge 78 and the second throat edge 80 in another way. Thus, the shoelace 143 can be tightened to make the upper 12 more narrow for securing the upper 12 to the wearer's foot. The shoelace 143 can also be loosened to make the upper 12 wider for releasing the upper 12 from the wearer's foot.

In the embodiments illustrated in FIGS. 1 and 5, the shoelace 143 is received within one or more eyelets. The eyelets can be formed in any suitable location on the first member 50. For example, the eyelets can be formed within the first panel 64 and the second panel 66 in some embodiments. Also, the eyelets can be formed within the tongue 90. Moreover, in some embodiments, the shoelace 143 can be received within a passage 151 that is partially defined by the tongue 90 and either the first panel 64 or the second panel 66 of the first member 50. For example, a representative passage 151 is shown in FIGS. 5 and 6. The passage 151 comprises a first opening 146 formed within the second layer 134 of the tongue 90, a second opening 148 formed within the first panel 64 of the first member 50, and a third opening 150 formed within the third layer 136 of the tongue 90. As shown, the first opening 146, second opening 148, and third opening 150 can be aligned. In other embodiments, the first opening 146, second opening 148, and third opening 150 can be offset. In still additional embodiments, the first opening 146, second opening 148, and third opening 150 can be spaced apart. A corresponding section of the shoelace 143 can be received within the passage 151 to secure the shoelace 143 to the first throat edge 78. Accordingly, the overlapping layers created by the tongue 90 and the first panel 64 can ensure that the passage 151 is strong and robust. Thus, even if the materials used to create the first member 50 are lightweight, the shoelace 143 can be securely attached. Other passages 151 on the first member 50 can be similarly constructed along the first throat edge 78 and/or the second throat edge 80, and the shoelace 143 can be similarly secured.

As shown in FIG. 5, when the shoelace 143 is untied, the throat opening 82 can be relatively wide. As such, the wearer can insert or remove a foot from the void 76 of the upper 12. However, the shoelace 143 can be tensioned and tied as shown in FIG. 6. As such, the first throat edge 78 can be moved toward the second throat edge 80 the throat opening 82 can be more narrow to secure the wearer's foot within the void 76.

As stated, the upper 12 can also include the second member 52, which cooperates with the first member 50 to define the void 76 of the upper 12. As will be discussed, the second member 52 can include one or more areas that attach to the first member 50. These areas of the second member 52 reinforce the first member 50. These areas can also provide additional support to the wearer's foot. Moreover, in some embodiments, the second member 52 can extend continuously between opposing areas of the first member 50 as will be discussed. Thus, the second member 52 can interconnect opposing areas of the first member 50 to distribute loads through the upper 12. Also, the second member 52 can be configured to combine certain structural features included in traditional articles of footwear. As such, the article of footwear 10 can be assembled from fewer parts than other traditional articles of footwear. Additionally, the second member 52 can reduce the weight of the article of footwear 10 as will be discussed in detail.

In some embodiments, the second member 52 can be made from a sheet of material, such as leather, suede, fabric, or other material. Also, the second member 52 can include an upper surface 101 that faces away from the sole structure 14. The second member 52 can further include a lower surface 103 that faces in an opposite direction from the upper surface 101. The lower surface 103 can engage and attach with the sole structure 14 in some embodiments.

Figure 11:
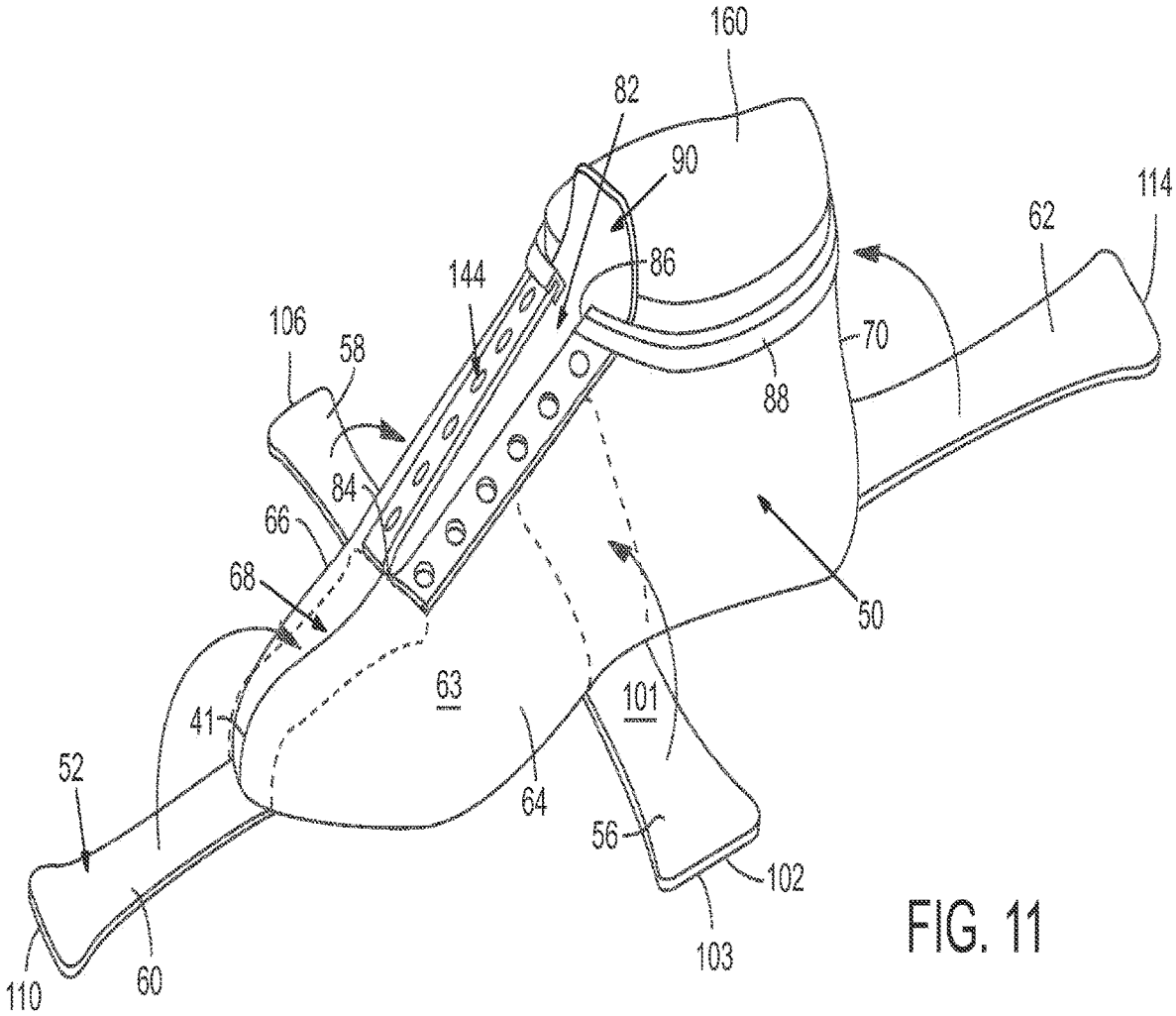
FIG. 11 is a perspective view schematically illustrating further manufacture of the article of footwear of FIG. 1.

As shown in FIG. 7, the second member 52 can include a body 55 and at least one support arm that extends from the body 55. Also, as shown in FIG. 11, the arm(s) can extend upward away from the body 55 to attach to the first member 50. The arm(s) can attach to the exterior surface 63 of the first member 50 in some embodiments. In other embodiments, the arm(s) can attach to the interior surface 61 of the first member 50. Also, the arm(s) can attach to the medial side 20, to the lateral side 22, to the forefoot region 16, and/or to the heel region 18 of the first member 50. Additionally, two or more arms can attach to opposing sides or opposing ends of the first member 50 as will be discussed. Thus, as will be discussed, the second member 52 can reinforce the first member 50 and make the first member 50 robust.

In some embodiments represented in FIG. 7, the body 55 can be shaped to generally correspond to the shape of the lower peripheral edge 54 of the first member 50. Also, the second member 52 can include a first arm 56, a second arm 58, a third arm 60, and a fourth arm 62 that extend can extend generally away from each other and that can extend away from the body 55. The first arm 56 can extend from the medial side 20 of the body 55, and the second arm 58 can extend in an opposite direction from the lateral side 22 of the body 55. Moreover, the third arm 60 can extend from the forefoot region 16 of the body 55, and the fourth arm 62 can extend from the heel region 18 of the body 55.

Additionally, as shown in FIG. 7, the first arm 56 can include a first end 100 that is attached to the body 55 and a second terminal end 102 that is spaced away from the body 55. The first arm 56 can be tapered in some embodiments such that the second terminal end 102 is wider than the first end 100. The second arm 58 can similarly include a first end 104 and a second end 106, and the second arm 58 can be similarly tapered. Furthermore, the third arm 60 can similarly include a first end 108 and a second end 110, and the third arm 60 can be similarly tapered. Moreover, the fourth arm 62 can include a first end 112 and a second end 114, and the fourth arm 62 can be tapered between the first end 112 and the second end 114. Also, as shown in the illustrated embodiments, the second end 102 can be bulb-shaped. Likewise, the second end 106 of the second arm 58, the second end 110 of the third arm 60, and/or the second end 114 of the fourth arm 62 can be bulb-shaped in some embodiments.

The second member 52 can be attached to the first member 50 such that the body 55 covers over the underfoot opening 33 of the first member 50. Also, in some embodiments, the body 55 can attach to the first member 50 along the lower peripheral edge 54 of the first member 50.

Moreover, the first arm 56 can extend along the medial side 20 of the first panel 64 of the first member 50. More specifically, the upper surface 101 of the first arm 56 can attach to the exterior surface 63 of the first member 50. In some embodiments, the first arm 56 can be long enough such that the second end 102 is adjacent the third layer 136 of the tongue 90 near the throat opening 82. Also, the first arm 56 can extend over the first member 50 such that the first arm 56 reinforces the midfoot region 17 and is substantially centered on the arch area of the wearer's foot. Accordingly, the first arm 56 can support the wearer's arch.

Additionally, the upper surface 101 of the second arm 58 can extend over and can attach to the exterior surface 63 along the lateral side 22 of the second panel 66 of the first member 50. In some embodiments, the second end 106 can be spaced from the fifth layer 140 of the tongue 90 as shown in FIGS. 5 and 6. Additionally, the second arm 58 can extend over the first member 50 such that the second arm 58 reinforces the midfoot region 17 and is substantially centered over the joint between the metatarsal and the phalange of the small toe of the wearer's foot. Accordingly, the second arm 58 can support this portion of the wearer's foot.

Furthermore, the upper surface 101 of the third arm 60 can extend over and attach to the exterior surface 63 along the forefoot region 16 of the first member 50. In some embodiments, the third arm 60 can overlap the first seam 68 such that the first seam 68 is substantially shielded from view. Moreover, the third arm 60 can be long enough such that the second end 110 is adjacent the forward end 84 of the throat opening 82. For example, the second end 110 of the third arm 60 can overlap the tongue 90 adjacent the forward end 84 as shown in FIG. 1.

Additionally, the upper surface 101 of the fourth arm 62 can extend over and attach to the exterior surface 63 along the heel region 18 of the first member 50. In some embodiments, the fourth arm 62 can overlap the second seam 70 such that the second seam 70 is substantially shielded from view. Moreover, the fourth arm 62 can be long enough such that the second end 114 projects away from the rim 72 of the first member 50. Thus, the second end 114 can act as a pull tab and can be used by the wearer when pulling on the footwear 10 onto the wearer's foot.

Attached as such, the second member 52 can cover over and reinforce portions of the first member 50. Areas of the first member 50 between the arms of the second member 52 can remain exposed. For example, an exposed area of the exterior surface 63 is indicated at 153 in FIGS. 1 and 3 between the first arm 56 and the third arm 60.

Additionally, it will be appreciated that the upper surface 101 of the body 55 of the second member 52 can face the wearer's foot and can partially define the void 76 within the upper 12. Also, the body 55 can extend between and attach to both the first panel 64 and the second panel 66. Moreover, the body 55 can extend underneath the wearer's foot, and the first arm 56, the second arm 58, the third arm 60, the fourth arm 62 can wrap around the wearer's foot such that the second member 52 substantially cradles the wearer's foot. Accordingly, the second member 52 can provide significant support to the wearer's foot. Moreover, in some embodiments, the first arm 56 can have some rigidity such that the first arm 56 is biased to rotate about the first end 100 away from the void 76. As a result, the first arm 56 can provide lift for the medial side 20 of the first member 50 away from the sole structure 14. Stated differently, the medial side 20 can be self-supporting due to the rigidity of the first arm 56. Likewise, the second arm 58 can have some rigidity to provide lift to the lateral side 22, the third arm 60 can have some rigidity to provide lift to the forefoot region 16, and the fourth arm 62 can have some rigidity to provide lift to the heel region 18. It will be appreciated that a traditional heel counter, a toe box, or other stiffeners may not be necessary due to the second member 52. Accordingly, the part count of the footwear 10 can be reduced for reducing weight of the footwear 10 and for increasing manufacturing efficiency.

Referring now to FIGS. 8-13, manufacture of the footwear 10 will be discussed in greater detail according to exemplary embodiments. It will be appreciated that the manufacturing of the footwear 10 can progress in any sequence. Also, one or more steps can be performed manually. In other embodiments, one or more steps can be performed automatically using a suitable machine, robot, or other implement. Furthermore, some steps can be combined. Moreover, some steps can be performed in sequence. Additionally, some steps can occur substantially at the same time.

Figure 8:
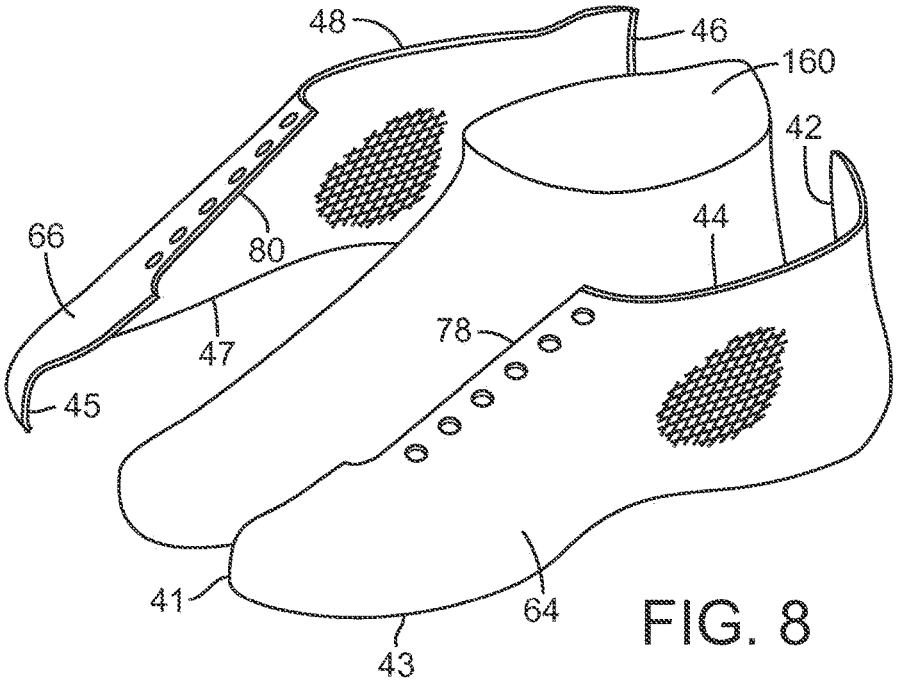
FIG. 8 is a perspective view schematically illustrating manufacture of a portion of the article of footwear of FIG. 1.

In some embodiments, manufacture of the footwear 10 can begin by attaching the first panel 64 and the second panel 66 together. Once attached, the tongue 90 and/or the collar 88 can be attached to the first panel 64 and the second panel 66. For example, as represented in FIG. 8, the first panel 64 and the second panel 66 can be fit about an assembly support structure, such as a foot-shaped last 160. The last 160 can have a predetermined size that corresponds to a particular shoe size. In other embodiments, the first panel 64 and the second panel 66 can be attached without the use of a last 160.

As described above, the forward edge 41 of the first panel 64 and the forward edge 45 of the second panel 66 can attach together to form the first seam 68. The forward edge 41 and the forward edge 45 can butt up against each other to form a butt joint at the seam 68. In other embodiments, the forward edge 41 and the forward edge 45 can overlap each other at the seam 68. Also, the first panel 64 and the second panel 66 can be attached at the seam 68 using any suitable attachment type. For example, the seam 68 can be formed using adhesives, fasteners, stitching, or another attachment device. For example, adhesive can be applied adjacent the edge 41 and/or the edge 45, and the edge 41 and the edge 45 can be pressed against each other until the adhesive dries.

Also, as shown in FIG. 8, the rear edge 42 and the rear edge 46 can attach together to form the second seam 70. The second seam 70 can be formed in the same way as the first seam 68 in some embodiments.

Figure 10:
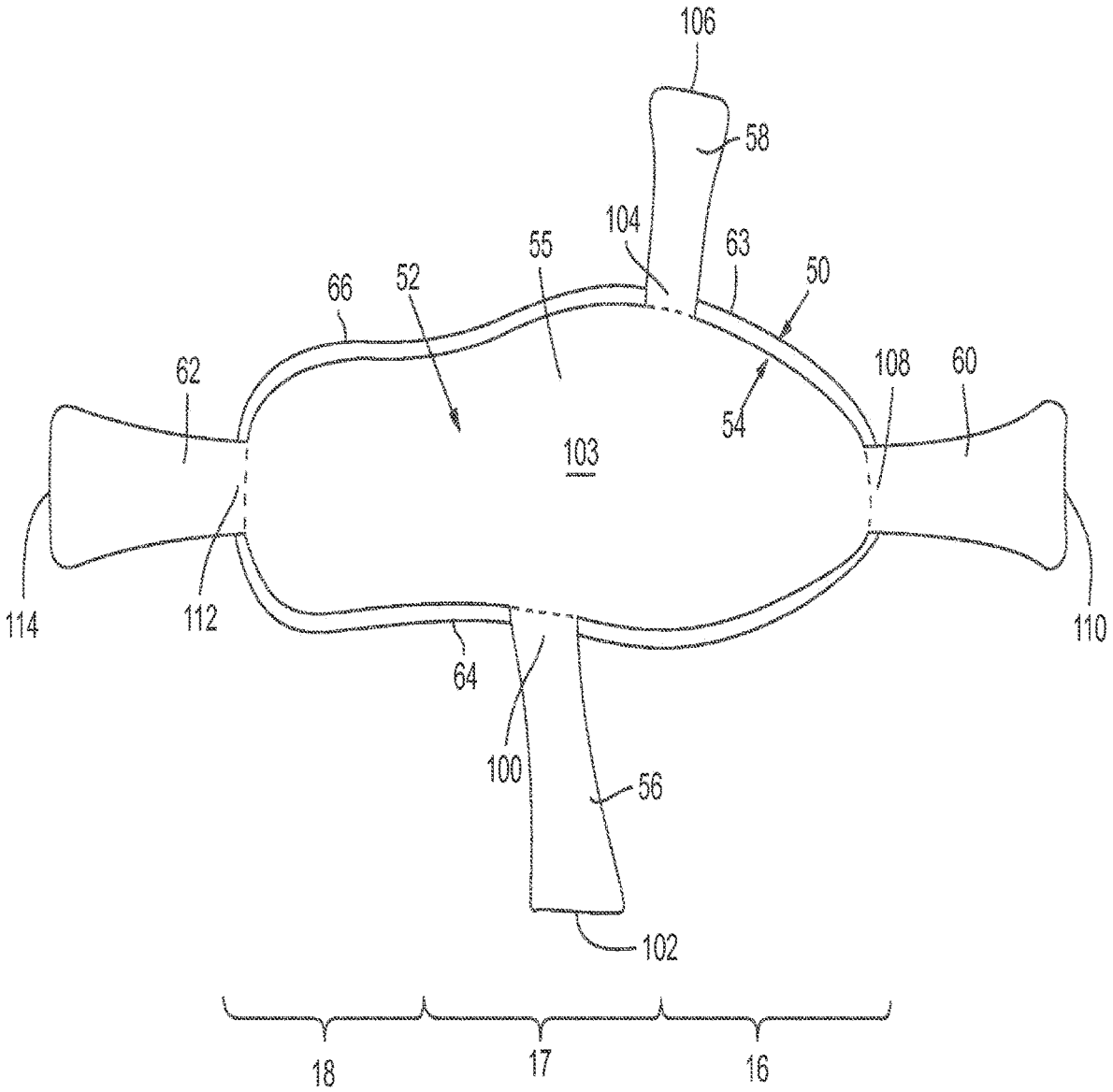
FIG. 10 is a bottom view schematically illustrating further manufacture of the article of footwear of FIG. 1.

Next, as shown in FIGS. 9-11, the second member 52 can be attached to the first member 50. As mentioned and as shown in FIG. 9, the body 55 can be attached along the lower peripheral edge 54 of the first member 50. The upper surface 101 of the body 55 can slightly overlap the exterior surface 63 of the first member 50 as shown in FIG. 9, and the upper surface 101 of the body 55 can attach to the exterior surface 63 of the first member 50. The body 55 can attach to the first member 50 using adhesives, fasteners, stitching, or another attachment device. For example, adhesive can be applied, and the body 55 can be pressed against the lower peripheral edge 54 until the adhesive is dried.

Next, as shown in FIGS. 10 and 11, the first arm 56, the second arm 58, the third arm 60, and the fourth arm 62 can be wrapped upwards to overlap the corresponding areas of the first member 50. The first arm 56, the second arm 58, the third arm 60, and the fourth arm 62 can be attached to the first member 50 using adhesives, fasteners, stitching, or another attachment device. For example, adhesive can be applied, and the first arm 56, second arm 58, third arm 60, and fourth arm 62 can be pressed against the first member 50 until the adhesive dries.

As shown in FIG. 11, the tongue 90 and the collar 88 can also be attached to the first member 50 as described in detail above. The tongue 90 and collar 88 can be attached as described above with respect to the attachment of the second member 52. Also, in some embodiments, the tongue 90 and the collar 88 can be attached before attaching the second member 52.

Figure 12:
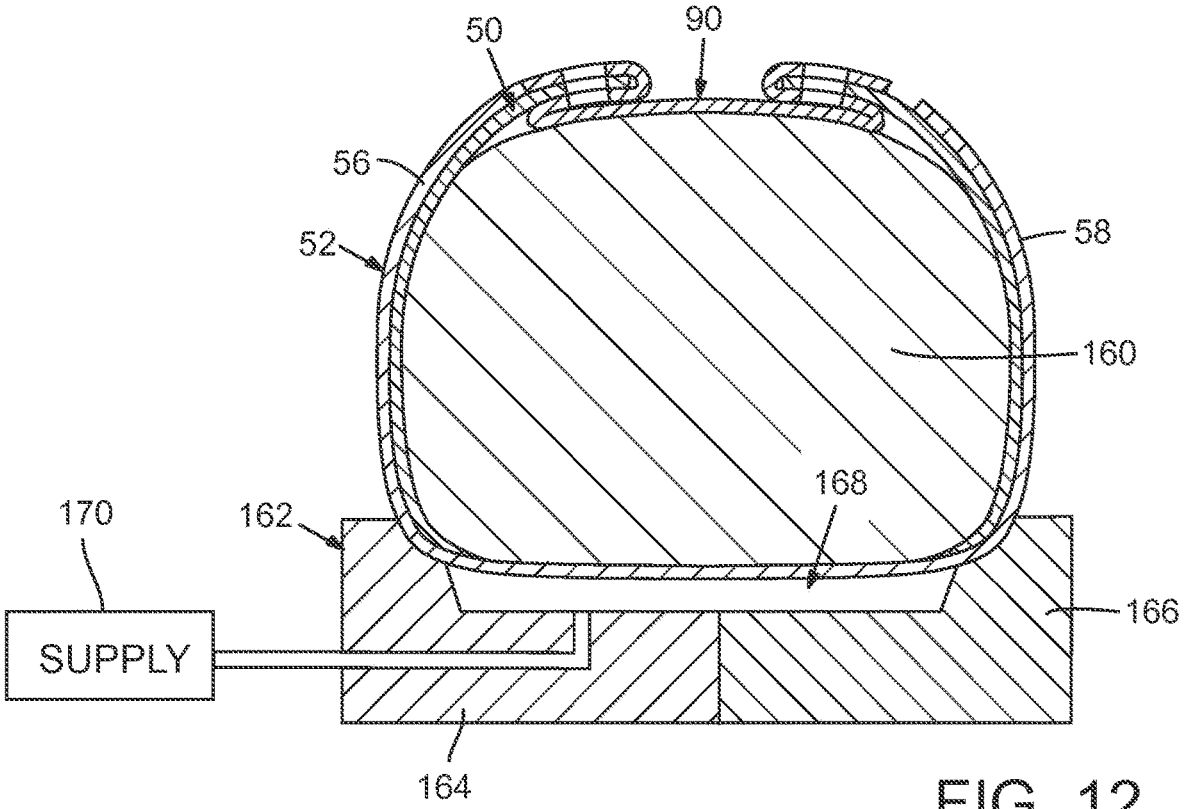
FIG. 12 is a schematic section view of the upper of the article of FIG. 1 shown operably coupled to a molding assembly for formation and attachment of a sole structure to the upper.
Figure 13:
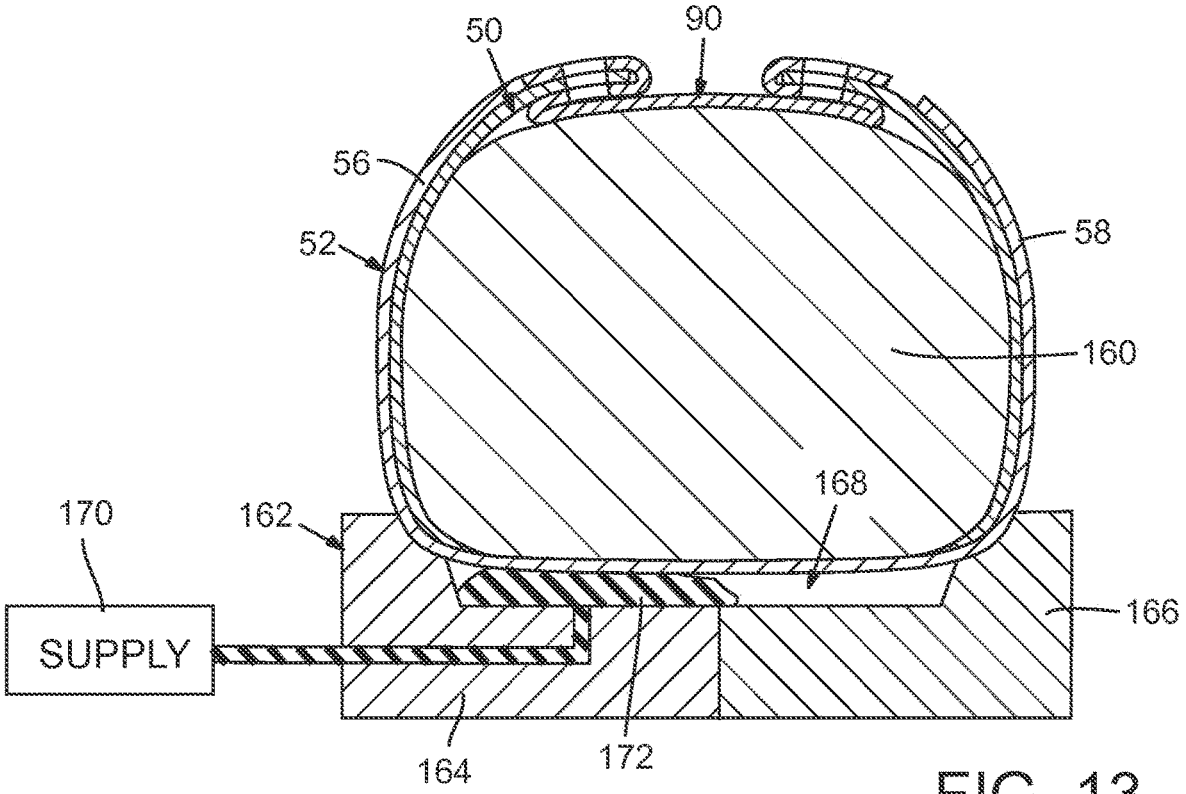
FIG. 13 is a schematic section view of the upper and the molding assembly of FIG. 12, wherein material shown being introduced into the mold cavity for formation of the sole assembly and attachment of the sole assembly to the upper.

Next, as shown in FIGS. 12 and 13, the sole structure 14 can be attached to the upper 12. As described above, the upper surface 40 of the sole structure 14 can be attached to the lower surface 103 of the body 55 of the second member 52. The upper surface 40 can also attach to portions of the first member 50 exposed from the second member 52. The sole structure 14 can be attached in any suitable way. For example, the sole structure 14 can be attached using adhesives, stitching, fasteners, or other device.

In additional embodiments, the sole structure 14 can be substantially simultaneously formed and directly attached to the upper 12. Stated differently, the sole structure 14 can be molded onto the upper 12. In some embodiments, this process can incorporate one or more of the teachings disclosed in U.S. Pat. No. 3,676,542, entitled "Manufacture of Footwear," and issued Jul. 11, 1972 to Maltby, which is hereby incorporated by reference in its entirety.

Accordingly, the sole structure 14 can be formed using a molding assembly 162. The molding assembly 162 can include a first mold 164 and a second mold member 166. The upper 12, the first mold 164, and the second mold member 166 can cooperate to define a mold cavity 168 as shown in FIG. 12. Also, the molding assembly 162 can include a material supply source 170 can be in fluid communication with the mold cavity 168. Then, as shown in FIG. 13, molten material 172 can flow from the supply source 170 to the mold cavity 168. The material can then cure until the sole structure 14 is formed and the sole structure 14 is attached to the upper 12.

Accordingly, the article of footwear 10 can be very lightweight. For example, the materials used to form the first member 50 can be very lightweight and breathable. Also, a traditional heel counter, a toe box, or other stiffeners may not be necessary because the second member 52 can provide ample support for the wearer's foot, can provide lift to the first member 50, and can reinforce the first member 50. Accordingly, the footwear 10 can enhance the wearer's running, jumping, or other ambulatory activities. Also, the footwear 10 can be manufactured in an efficient manner.

The foregoing description of the embodiments has been provided for purposes of illustration and description. It is not intended to be exhaustive or to limit the present disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the present disclosure, and all such modifications are intended to be included within the scope of the present disclosure.

What is claimed is:

1. An upper for an article of footwear, comprising:

an upper member having a lower peripheral edge, an interior surface, and an exterior surface opposite the interior surface, wherein the lower peripheral edge extends continuously around a bottom of the upper member from a forefoot region of the upper member to a heel region of the upper member and defines an opening at the bottom of the upper member; and a strobel comprising a sheet of material selected from the group consisting of: leather, suede, or fabric, the sheet of material including a first surface and a second surface opposite the first surface, the sheet of material extending contiguously to form:

(a) a body shaped to correspond to a shape of the lower peripheral edge of the upper member, (b) a first support arm that extends outwardly from the body at a medial side of the body, and (c) a second support arm that extends outwardly from the body at a lateral side of the body, wherein the body is attached to the lower peripheral edge of the upper member such that the body closes the opening at the bottom of the upper member and such that the first surface of the sheet of material forming the body and the interior surface of the upper member cooperate to form a void that is configured to receive a foot, wherein the first surface of the sheet of material forming the first support arm is layered on and attached to the exterior surface of the upper member at a medial side of the upper member, wherein the first surface of the sheet of material forming the second support arm is layered on and attached to the exterior surface of the upper member at a lateral side of the upper member, and wherein the second surface of the sheet of material forming the body defines a sole engaging surface configured to attach to a sole structure.

2. The upper of claim 1, wherein the first support arm is attached to the exterior surface of the upper member at a location configured to support an arch area of a wearer's foot, and wherein the second support arm is attached to the exterior surface of the upper member at a location configured to support a joint between a metatarsal and phalange of a small toe of a wearer's foot.

3. The upper of claim 1, wherein the strobel further includes: (i) a third support arm at a forefoot region of the body and layered on and attached to the exterior surface of the upper member at a forefoot region of the upper member, and (ii) a fourth support arm at a heel region of the body and layered on and attached to the exterior surface of the upper member at a heel region of the upper member.

4. The upper of claim 1, wherein the body of the strobel is attached to the upper member by stitching.

5. The upper of claim 4, wherein each of the first support arm and the second support arm is attached to the upper member by stitching.

6. The upper of claim 1, wherein each of the first support arm and the second support arm is attached to the upper member by stitching.

7. The upper of claim 1, wherein the body of the strobel is attached to the upper member by adhesive.

8. The upper of claim 7, wherein each of the first support arm and the second support arm is attached to the upper member by adhesive.

9. The upper of claim 1, wherein each of the first support arm and the second support arm is attached to the upper member by adhesive.

10. The upper of claim 1, wherein the body of the strobel is attached to the upper member by a fastener.

11. The upper of claim 1, wherein each of the first support arm and the second support arm is attached to the upper member by a fastener.

12. An upper for an article of footwear, comprising:

an upper member having a lower peripheral edge, an interior surface, and an exterior surface opposite the interior surface, wherein the lower peripheral edge extends continuously around a bottom of the upper member from a forefoot region of the upper member to a heel region of the upper member and defines an opening at the bottom of the upper member; and a strobel comprising a sheet of material selected from the group consisting of: leather, suede, or fabric, the sheet of material including a first surface and a second surface opposite the first surface, the sheet of material extending contiguously to form:

(a) a body shaped to correspond to a shape of the lower peripheral edge of the upper member, and (b) a first support arm that extends outwardly from the body at one of a medial side or a lateral side of the body, wherein the body is attached to the lower peripheral edge of the upper member such that the body closes the opening at the bottom of the upper member and such that the first surface of the sheet of material forming the body and the interior surface of the upper member cooperate to form a void that is configured to receive a foot, wherein the first surface of the sheet of material forming the first support arm is layered on and attached to the exterior surface of the upper member at one of a medial side or a lateral side of the upper member, and wherein the second surface of the sheet of material forming the body defines a sole engaging surface configured to attach to a sole structure.

13. The upper of claim 12, wherein the first support arm is attached to the exterior surface of the upper member at a location configured to support an arch area of a wearer's foot.

14. The upper of claim 12, wherein the first support arm is attached to the exterior surface of the upper member at a location configured to support a joint between a metatarsal and phalange of a small toe of a wearer's foot.

15. The upper of claim 12, wherein the body of the strobel is attached to the upper member by stitching.

16. The upper of claim 15, wherein the first support arm is attached to the upper member by stitching.

17. The upper of claim 12, wherein the first support arm is attached to the upper member by stitching.

18. The upper of claim 12, wherein the body of the strobel is attached to the upper member by adhesive.

19. The upper of claim 18, wherein the first support arm is attached to the upper member by adhesive.

20. The upper of claim 12, wherein the first support arm is attached to the upper member by adhesive.

21. The upper of claim 12, wherein the body of the strobel is attached to the upper member by a fastener.

22. The upper of claim 12, wherein the first support arm is attached to the upper member by a fastener.

* * * * *